US005921041A

United States Patent [19]

Egri, II

[11] Patent Number: 5,921,041

[45] Date of Patent: Jul. 13, 1999

[54] BOTTOM TRACK FOR WALL ASSEMBLY

[76] Inventor: John David Egri, II, 5200 Moore Rd., Lincoln, Calif. 95648

[21] Appl. No.: 08/999,302

[22] Filed: Dec. 29, 1997

[51] Int. Cl.[6] ..... E04H 1/00

[52] U.S. Cl. ..... 52/241; 52/232; 52/481.1

[58] Field of Search ..... 52/241, 232, 242, 52/481.1

[56] References Cited

U.S. PATENT DOCUMENTS

| | | | |
|---|---|---|---|
| 5,010,702 | 4/1991 | Daw et al. | 52/241 |
| 5,040,345 | 8/1991 | Gilmour . | |
| 5,125,203 | 6/1992 | Daw . | |
| 5,127,203 | 7/1992 | Paquette . | |
| 5,127,760 | 7/1992 | Brady . | |
| 5,155,962 | 10/1992 | Burkstrand et al. . | |
| 5,203,132 | 4/1993 | Smolik . | |
| 5,222,335 | 6/1993 | Petrecca . | |
| 5,321,924 | 6/1994 | Smolik . | |
| 5,394,665 | 3/1995 | Johnson . | |
| 5,412,919 | 5/1995 | Pellock et al. . | |
| 5,471,805 | 12/1995 | Becker . | |

OTHER PUBLICATIONS

Sliptrack System Load Test of Twining Laboratories of Southern California for Sliptrack System, Inc.

Brochure from Tremco for Tremstop WS, Through Penetration FIrestop–Instumescent Wrap Strip, Rev'd Apr. 1996.

Brochure from Tremco for Tremstop WBM, Water–Based Intumescent Mastic, Rev'd Apr. 1996. Pilot Scale Vertical Test conducted by Inchcap Testing Services for Sliptrack Systems, Inc.

IPC brochure for FS 900 Series Sealant, Jan. 1997.

IPC brochure for Safing Sealant, Apr. 1997.

IPC brochure for Fire Retardent ARC Tapes/Booths, Apr. 1997.

"Code Changes Put Scrutiny on Head–of–Wall Design", by T.C. Donovan, in Walls & Ceiling, Apr. 1997.

Fire Track brochure for Deflection Track & Firestop System.

Spec–Data sheet and listing information for A/D Firefilm Intumescent oating and A/D Colorcoat.

The Examiner's attention is also directed to the information Disclosure Citation filed in U.S. Patent Application SN 08/968,405 filed 11/12/97, for "Header Track for Wall Assembly".

*Primary Examiner*—Creighton Smith

[57] ABSTRACT

An improved bottom track for a stud wall assembly which includes a generally U-shaped channel member including two juxtaposed side wall portions connected at ninety degree angles to a base wall portion. A factory-installed elongated rectangular strip of a fire retardant material, such as caulking, extends along the length of each side wall. In use, the bottom track is secured in a conventional manner to the floor structure, through the base wall portion of the U-shaped channel member. Screws extending through the side walls of the channel member secure the channel member to a plurality of studs. Wall panels, such as dry wall, are attached to opposite lateral faces of the studs. The lower portion of the wall panels vertically overlap the fire retardant strips to create a continuous fire barrier from the wall panels to the floor substrate.

14 Claims, 2 Drawing Sheets

BOTTOM TRACK FOR WALL ASSEMBLY

CROSS-REFERENCE TO RELATED APPLICATIONS

This application is generally related to applicant's prior pending U.S. Utility Patent application Ser. No. 08/968,405 filed Nov. 12, 1997, entitled "Header Track For Wall Assembly," the entire disclosure of which is hereby incorporated by reference herein.

BACKGROUND OF THE INVENTION

1. Field of the Invention

The present invention relates to a wall assembly of the type employing studs in conjunction with wall panels, such as dry wall panels, and more particularly pertains to a new and improved bottom track assembly especially adapted to prevent movement of such stud walls, while simultaneously providing fire retardant materials adapted to maintain a seal adjacent a junction of the wall assembly and a room floor to afford maximum protection against fire.

2. Description of the Prior Art

The prior art related to metal stud wall construction is relatively crowded. Representative patents generally related to metal stud wall assemblies include U.S. Pat. No. 5,040,345, issued Aug. 20, 1991 to Michael F. Gilmour; U.S. Pat. No. 5,125,203, issued Jun. 30, 1992 to Terry L. Daw; U.S. Pat. No. 5,127,203, issued Jul. 7, 1992 to Robert F. Paquette; U.S. Pat. No. 5,127,260, issued Jul. 7, 1992 to Todd A. Brady; U.S. Pat. No. 5,155,962, issued Oct. 20, 1992 to Lowell E. Burkstrand et al.; U.S. Pat. No. 5,203,132, issued Apr. 20, 1993 to Robert A. Smolik; U.S. Pat. No. 5,222,335, issued Jun. 29, 1993 to Anthony Petrecca; U.S. Pat. No. 5,321,924, issued Jun. 21, 1994 to Robert A. Smolik; U.S. Pat. No. 5,394,665 to Gary Johnson; U.S. Pat. No. 5,412,919, issued May 9, 1995 to Michael A. Pellock et al.; and U.S. Pat. No. 5,471,805, issued Dec. 5, 1995 to Duane W. Becker. The entire disclosures of each of the foregoing patents is hereby incorporated herein by this reference thereto.

The prior art discloses wall assemblies that utilize a U-shaped channel member that is attached to a floor. Studs and wall panels, such as dry wall, are attached to the channel member to create wall assemblies. Frequently, wall assemblies are designed to provide fire protection that are given a timed rated designation, i.e., one hour or two hour fire rating per ASTM E-119. At these ratings, the wall panels, such as dry wall, are required to be installed with a quarter-inch to half-inch gap between the bottom of the wall panel and the floor. The gap must then be filled with fire rated caulk. This creates substantial problems:

1. The proper installation of caulking requires that the surfaces to receive the caulk be free of dust and dirt. This requires a worker to scrape, sweep and blow with compressed air, the gap created for the caulking. In practice, this cleaning is frequently inadequate, resulting in a defective wall assembly.
2. a. Dry wall is a panel constructed of a gypsum base core surrounded on the front, back, and long edges with paper. The short edges are uncovered, leaving the gypsum core exposed.
   b. In the process of installing dry wall, the panels are cut to fit. This exposes the gypsum base core.
   C. Frequently, the exposed gypsum base core is installed at the bottom of the wall assembly.
   d. The gypsum base core is friable, and does not provide an adequate surface to bond with caulking.

3. The caulking is installed at floor level, a difficult location to work.

Accordingly, there is a need for an improved stud wall assembly including a bottom track which meets applicable building codes and fire rating, which is at the same time economical to produce and install in the field.

SUMMARY OF THE INVENTION

An improved bottom track for a stud wall assembly includes a generally U-shaped channel member including two juxtaposed side wall portions connected at ninety degree angles to a base wall portion. A factory-installed elongated rectangular strip of a fire retardant material, such as caulking, extends along the length of each side wall. In use, the bottom track is secured in a conventional manner to the floor structure, through the base wall portion of the U-shaped channel member. Screws extending through the side walls of the channel member secure the channel member to a plurality of studs. Wall panels, such as dry wall, are attached to opposite lateral faces of the studs. The lower portion of the wall panels vertically overlap the fire retardant strips to create a continuous fire barrier from the wall panels to the floor substrate.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described preferred embodiments of the invention.

DETAILED DESCRIPTION OF THE PREFERRED EMBODIMENTS

Figure 1:
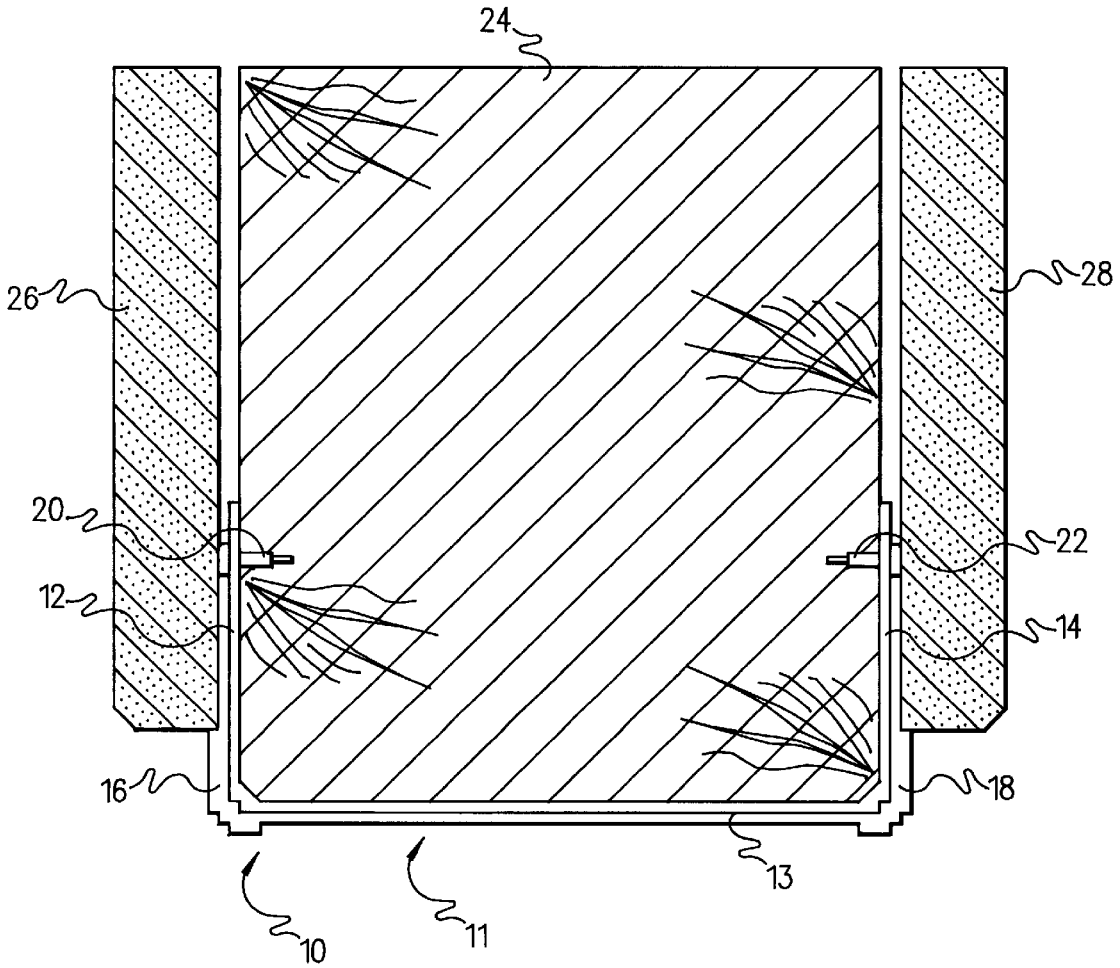
FIG. 1 is a partial longitudinal cross-sectional view of a stud wall assembly employing the bottom track according to the present invention.
Figure 2:
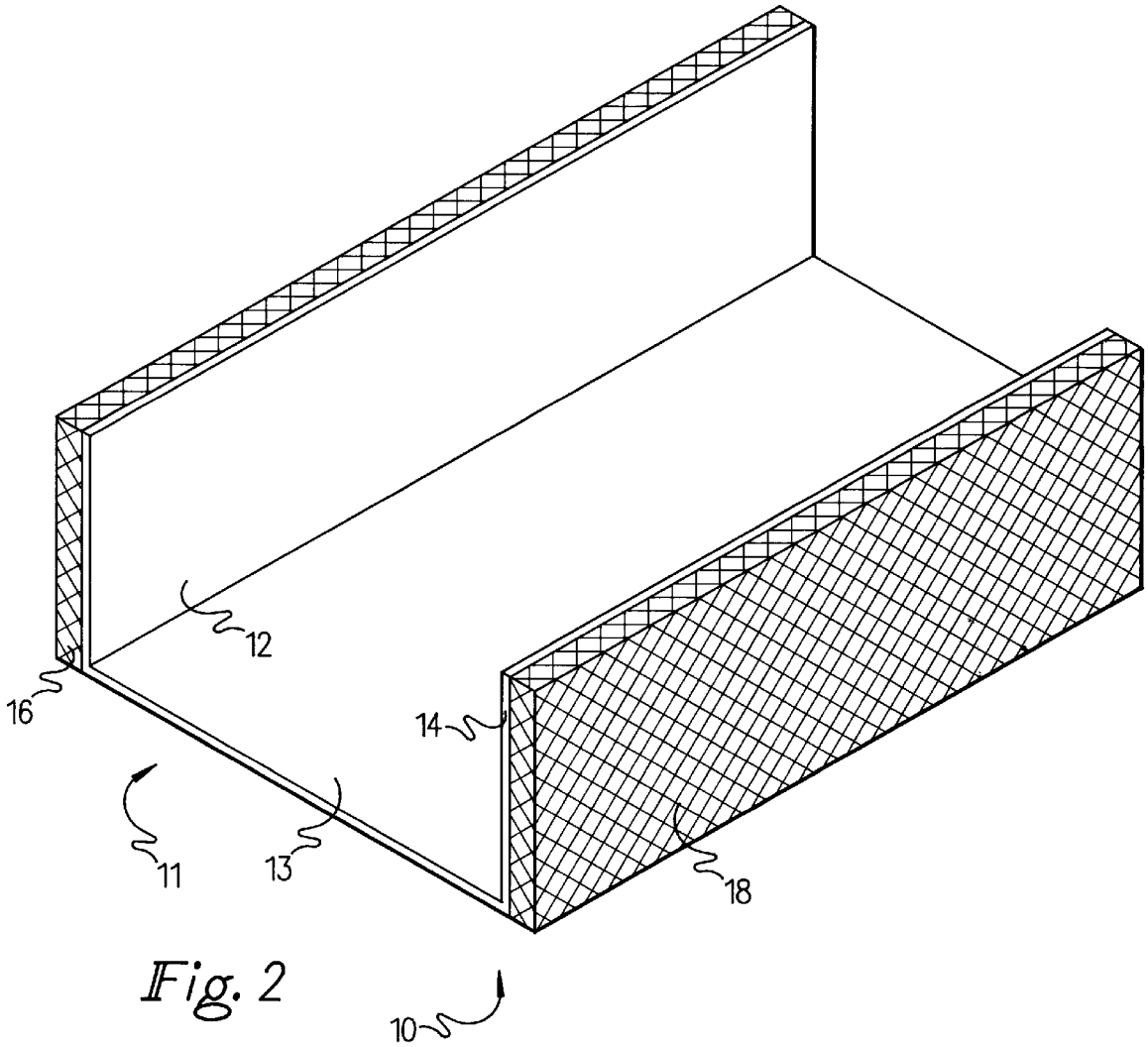
FIG. 2 is a partial perspective view illustrating the bottom track according to the present invention.

Referring now to the drawings, wherein like reference numerals designate corresponding structure throughout the views, and referring in particular to FIGS. 1 and 2, an improved bottom track 10 for a wall assembly according to a preferred embodiment of the invention includes a generally U-shaped channel member 11 provided with two juxtaposed side wall portions 12 and 14 disposed in spaced, parallel relation. A lower base wall 13 extends transversely between and connects the side wall portions 12 and 14. The channel member 11 may be formed from a conventional sheet metal material using known roll forming, metal bending, or extrusion techniques. Factory installed elongated strips 16 and 18 of a fire retardant material, such as caulking, extend along the length of each of the side walls 12 and 14. In use, a plurality of screws 20 and 22 extend through the side wall portions 12 and 14 of the channel member 11, securing a plurality of studs 24 to the channel member 11. A pair of wall panels 26 and 28, such as dry wall, are attached to opposite lateral faces of the studs 24. The lower end portions of the wall panels 26 and 28 vertically overlap the fire retardant strips 16 and 18 extending along the side wall portions 12 and 14 of the channel member 11, thereby creating a continuous fire barrier formed by the wall panels 26 and 28 and the strips 16 and 18.

The lower or base wall portion 13 of the bottom track 10 is secured in a conventional manner to a floor structure such as wood, concrete slab, or other such conventional structures.

In addition to providing a fire barrier, the retardant strips 16 and 18 of the present invention also function to help reduce the transmission of sound through the wall structure.

The improved bottom track according to the present invention provides several advantages over the prior art. The inventive bottom track provides a secure connection for wall components, such as studs and wall panels, and also maintains the continuity of the fire rated wall to the floor structure disposed below.

In accordance with the present invention, the retardant strips 16 and 18 are formed from a caulking type substance that has a fire rating in and of itself This caulking substance is factory applied to the bottom track, obviating the aforementioned problems associated with the prior art, and providing a substantial savings in labor and thus also in construction time and costs. The bottom track and metal stud wall system according to the present invention provides many advantages, including the following:

1. The inventive bottom track is compatible with all types of primary wall material, including dry wall, plywood, cement board, all wall boards, and wet applied material such as plaster.

2. The factory application of the fire retardant caulking material saves labor time and costs while increasing uniformity of product quality.

3. To obtain the desired continuity of a rated wall, the installers need merely overlap the fire retardant caulking substance with the primary wall material, thus eliminating the need for the separate, tedious, and expensive application of separate fire retardant caulk.

4. The factory application of the fire retardant caulking material provides a uniform, stable fire rating.

5. Factory applied caulking retardant material costs a small fraction of the greatly increased labor costs associated with the prior art wall systems.

A variety of conventional fire retardant caulking type materials may be used in accordance with the present invention. Preferably, the material will meet ASTM E-119 requirements. Basically, this means that the material must substantially prevent heat transfer from one side of the wall to the other, in excess of the temperature required to ignite cotton fibers. The material must also withstand a fire hose water test. Intumescent coatings or caulking material is preferred. Intumescent coating, at a given temperature, has a chemical reaction that makes it expand from a thickness of ⅛ inch to 4 inches. Such products should result in a bottom track assembly which meets UL fire test requirements. As an alternative to a coating, an intumescent tape product might be employed, allowing installers to peel the tape away from the bottom track for a limited extent to avoid damaging the material when cutting the track to length using a power saw. Non-intumescent caulking materials may also be employed. Suitable fire retardant materials include the following:

1. Intumescent wrap strip of the type available from TREMCO, 3735 Green Road, Beachwood, Ohio 44122, under the trademarks TREMSTOP WS and INTUMEX.

2. A water-based spray on safing sealant of the type available from IPC (International Protective coatings Corporation)under the trademarkFLAMESAFE SAFING SEALANT.

3. A fire retardant arc tape of the type available from IPC (International Protective Coatings Corporation) under the trademark FLAMESAFE.

4. Sealants of the type available from IPC (International Protective Coatings Corporation) under the trademark FLAMESAFE FS 900 Series Sealant.

5. Water-based intumescent mastic of the type available from TREMCO, 3735 Green Road, Beachwood, Ohio 44122, under the trademarks TREMSTOP WS and INTUMEX.

6. Water-based intumescent coating of the type available from A/D Fire Protection Systems, Inc., 420 Tapscott Road, Scarborough, Ontario, Canada M1B1Y4, under the trademark A/D Firefilm Intumescent Coating.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts or types of material within the principles of the invention to the full extent indicated by the broad general meaning of the terms in which the appended claims are expressed.

What is claimed is:

1. A bottom track for a wall assembly, comprising:

a generally U-shaped channel member including two juxtaposed side portions connected by a base wall portion;

an elongated rectangular strip of a fire retardant material extending along the length of each of said side walls; and said fire retardant material comprising a caulking material.

2. A bottom track for a wall assembly, comprising:

a generally U-shaped channel member including two juxtaposed side portions connected by a base wall portion;

an elongated rectangular strip of a fire retardant material extending along the length of each of said side walls; and said fire retardant material comprising a tape strip.

3. A bottom track for a wall assembly, comprising:

a generally U-shaped channel member including two juxtaposed side portions connected by a base wall portion;

an elongated rectangular strip of a fire retardant material extending along the length of each of said side walls; and said fire retardant material comprising an intumescent coating.

4. A bottom track for a wall assembly, comprising:

a generally U-shaped channel member including two juxtaposed side portions connected by a base wall portion;

an elongated rectangular strip of a fire retardant material extending along the length of each of said side walls; and said fire retardant material comprising an intumescent tape strip.

5. A wall assembly , comprising:

a generally U-shaped channel member including two juxtaposed side portions connected by a base wall portion;

an elongated rectangular strip of a fire retardant material extending along the length of each of said side walls;

at least one stud having a lower end disposed between said sidewalls of said channel member;

fasteners extending through said channel member securing opposite lateral faces of said stud; and wall panels fastened to said studs and said channel member with lower ends of said wall panel at least partially vertically overlying said fire retardant strips to establish a substantial fire barrier.

6. The wall assembly of claim 5, wherein said fire retardant material comprises a caulking material.

7. The wall assembly of claim 5, wherein said fire retardant material comprises a tape strip.

8. The wall assembly of claim 5, wherein said fire retardant material comprises an intumescent coating.

9. The wall assembly of claim 5, wherein said fire retardant material comprises an intumescent tape strip.

10. A method of constructing a wall assembly in a commercial or residential building, comprising the steps of:

providing a generally U-shaped channel member including two juxtaposed side wall portions connected by a base wall portion and an elongated rectangular strip of a fire retardant material extending along the length of each of said side walls;

securing said channel member to a floor of said building;

attaching a plurality of studs to said channel member, said studs disposed between said side wall portions of said channel member; and securing a pair of wall panels to opposite lateral faces of said studs, bottom edges of said wall panels disposed above said floor to form a gap, with said fire retardant strips vertically overlapping said bottom edges of said wall panels to form a continuous fire barrier.

11. The method of claim 10, wherein said fire retardant material comprises a caulking material.

12. The method of claim 10, wherein said fire retardant material comprises a tape strip.

13. The method of claim 10 wherein said fire retardant material comprises an intumescent coating.

14. The method of claim 10, wherein said fire retardant material comprises an intumescent tape strip.

* * * * *